US006124669A

United States Patent [19]

Okamoto

[11] Patent Number: 6,124,669

[45] Date of Patent: Sep. 26, 2000

[54] COLOR CATHODE RAY TUBE

[75] Inventor: Hisakazu Okamoto, Kumagaya, Japan

[73] Assignee: Kabushiki Kaisha Toshiba, Kawasaki, Japan

[21] Appl. No.: 09/148,417

[22] Filed: Sep. 4, 1998

[30] Foreign Application Priority Data

Sep. 4, 1997 [JP] Japan ..... 9-239596

[51] Int. Cl.[7] ..... H01J 29/70

[52] U.S. Cl. ..... 313/431; 313/426; 313/427; 313/442; 335/210

[58] Field of Search ..... 313/421, 426, 313/427, 428, 430, 431, 432, 433, 442, 443; 335/210, 211

[56] References Cited

U.S. PATENT DOCUMENTS

| | | | |
|---|---|---|---|
| 4,670,726 | 6/1987 | Ogata et al. | 335/212 |
| 5,557,164 | 9/1996 | Chen et al. | 313/440 |
| 5,708,323 | 1/1998 | Okamoto | 313/431 |

FOREIGN PATENT DOCUMENTS 0 643 413 3/1995 European Pat. Off. .

0 884 756 12/1998 European Pat. Off. .

*Primary Examiner*—Nimeshkumar D. Patel
*Assistant Examiner*—Michael J. Smith
*Attorney, Agent, or Firm*—Pillsbury Madison & Sutro LLP

[57] ABSTRACT

A pair of first magnetic bodies extending in a direction of an X-axis are so disposed as to be opposed to each other on the X-axis in order to shield an external magnetic field acting on three electron beams lined side by side in the direction of X-axis. A pair of arcuated second magnetic bodies are disposed symmetric with respect to the X-axis in the vicinity of a Y-axis at a predetermined distance from a ring-shaped six-pole magnet plate. The first magnetic bodies, second magnetic bodies and six-pole magnet plate are arranged in this positional relationship, whereby a predetermined magnetic field distribution is created. Cathodes of an electron gun structure are arranged in such a position that a sum of a positive magnetic field component is substantially equal to a sum of.the negative magnetic field component on the trajectory of a center beam. Thereby, a force component acting on the center beam can be reduced without reducing force components acting on both side beams, and undesirable movement of the center beam can be prevented.

16 Claims, 10 Drawing Sheets

COLOR CATHODE RAY TUBE

BACKGROUND OF THE INVENTION

The present invention relates generally to a color cathode ray tube and more particularly to an in-line type color cathode ray tube having an in-line type electron gun structure, wherein convergence characteristics of electron beams emitted from the in-line type electron gun structure are improved.

In general, an in-line type color cathode ray tube, as shown in FIG. 1, has an envelope comprising a panel 1 and a funnel 2 formed continuous with the panel 1. An inner surface of the panel 1 is provided with a phosphor screen 3 composed of three-color phosphor layers emitting red (R), green (G) and blue (B) respectively. A shadow mask 4 is disposed adjacent, and opposed to, the phosphor screen 3.

A neck 5 of the funnel 2 of the color cathode ray tube includes an in-line type electron gun structure for emitting three electron beams which are lined side by side on a horizontal axis, i.e. an X-axis, as shown in FIG. 2. Specifically, the electron gun structure emits a center beam directed to the green phosphor layer of the phosphor screen 3 and a pair of side beams directed to the red and blue phosphor layers of the phosphor screen 3.

In addition, the color cathode ray tube, as shown in FIG. 1, has a deflector 6 mounted on the outer peripheral surface of a portion extending between the funnel 2 and neck 5. A two-pole magnet 7 having a pair of an N-pole and an S-pole, which are opposed to each other, is disposed at a rear end portion of the deflector 6. The two-pole magnet 7 is used to adjust landing of electron beams.

A convergence magnet 8 is disposed on the outside of the neck 5. The convergence magnet 8 has at least a ring-shaped four-pole magnet plate 11 and a ring-shaped six-pole magnet plate 10. The four-pole magnet plate 11 has two pairs of N-poles and S-poles which are opposed to each other. The six-pole magnet plate 10 has three pairs of N-poles and S-poles which are opposed to each other.

At the time of non-deflection, the two-pole magnet 7 and convergence magnet 8 function to register the three electron beams, emitted from the electron gun structure, at a center of the phosphor screen 3, thereby achieving high color purity and convergence.

In the color cathode ray tube, the three electron beams emitted from the electron gun structure are deflected by a non-homogeneous magnetic field produced by the deflector 6 and scanned over the phosphor screen. Thus a color image is reproduced on the phosphor screen 3.

In the in-line type color cathode ray tube, the electron beams are susceptible to an external magnetic field such as earth magnetism. The conditions of external magnetic field vary when the picture tube is situated in use in a direction different from the direction in which the convergence adjustment was made, or when the picture tube is used on a location where the condition of earth magnetism differs from that at a place of adjustment. Consequently, there may arise a problem in that a red image and a blue image displayed on the phosphor screen by a pair of side beams are vertically displaced from each other. The theory of occurrence of this phenomenon is as follows.

According to Jpn. Pat. Appln. KOKAI Publication No. 7-250335, an electron gun structure is disposed within the neck, as described above. The electron gun structure has a cathode which is heated by a heater to emit thermal electrons. The cathode is formed of a low-thermal-expansion material, i.e. magnetic material. For example, when an external static magnetic field such as earth magnetism has intersected with a tube axis or a Z-axis of the neck portion in a use environment, the external magnetic field is converged toward the cathode or magnetic body. Consequently, magnetic fields in horizontally opposite directions act on the paired side beams, in particular, of the three electron beams. These mutually opposite magnetic fields exert mutually opposed forces to the side beams.

In other words, the external magnetic field has horizontal components or X-axis components in mutually opposed directions with respect to the side beams. For example, when an external magnetic field in a positive direction along the X-axis acts on the electron beam for red, a force acts in a vertically downward direction, i.e. in a negative direction along the Y-axis and the electron beam for read shifts in the negative direction along the Y-axis. On the other hand, an external magnetic field in a negative direction along the X-axis acts on the electron beam for blue. Thus, a force acts in a positive direction along the Y-axis and the electron beam for blue shifts in the positive direction along the Y-axis. Consequently, a red image and a blue image displayed on the phosphor screen by the pair of side beams are vertically displaced relative to each other.

According to the idea disclosed in Jpn. Pat. Appln. KOKAI Publication No. 7-21938, if three electron beams are converged, a pair of side beams have magnetic field components opposite to each other in the X-axis direction. If an external magnetic field in the Z-axis direction is applied in this state, images displayed by the side beams will be vertically displaced relative to each other due to Lorentz force as described above.

In order to prevent displacement of images displayed by the side beams, a pair of magnetic bodies 9 for shielding the Z-directional external magnetic field are disposed, as shown in FIG. 2. The magnetic bodies 9 extend along the Z-axis and are situated on both sides of the neck 5 in the X-axis direction.

The magnetic bodies 9 are normally fixed in the Z-direction on the inner surfaces of a cylindrical holder H of the convergence magnet 8, as shown in FIG. 2, in order to reduce the number of fixation steps and to control the precision in fixation.

On the other hand, the six-pole magnet plate 10, as shown in FIG. 3, has three N-poles and three S-poles equidistantly arranged on the ring-shaped magnet plate. These poles are alternately arranged and produce a magnetic field distribution, as shown in FIG. 3. According to this distribution, a force in the same direction is applied to the pair of side beams and varies the trajectories. On the other hand, the magnetic field intensity is canceled and set at substantially zero on the trajectory of the center beam, i.e. the center axis of the color cathode ray tube, and no force acts to vary the trajectory.

If the convergence magnet for projecting the static magnetic field for correcting the trajectories of three electron beams and the magnetic bodies for shielding the external magnetic field are arranged within the limited dimensions of the neck portion, as described above, part of the strip-like magnetic bodies intersects with part of the ring-shaped magnet plate.

If the magnetic bodies and magnet plate are arranged close to each other, the magnetic bodies are magnetized by the function of the magnet plate, in particular, the magnetic poles of the six-pole magnet plate. As a result, the following problem will occur.

FIGS. 4A and 4B show a distribution of a magnetic field produced by the six-pole magnet plate when the trajectories of both side beams of the three electron beams are to be corrected in the positive direction along the Y-axis, and the state in which the magnetic bodies are magnetized.

In this case, the six-pole magnet plate 10 is situated such that one of the N-poles and one of the S-poles are positioned on the X-axis. At this time, portions of the magnetic bodies 9*a* and 9*b* arranged opposite to each other on the X-axis are situated near the N-pole and S-pole of the six-pole magnet plate 10. Thus, the portions of the magnetic bodies 9*a* and 9*b,* which are situated near the poles of the six-pole magnet plate 10, are magnetized with polarities opposite to those of the adjacent poles. The entire magnetic bodies are magnetized in its length direction, i.e. the Z-axis direction. As a result, two-pole magnetic fields are produced at the front end portions of the magnetic bodies, i.e. the end portions near the magnet plate, and the rear end portions of the magnetic bodies.

Specifically, an S-pole is produced on that surface of the magnetic body 9*a* located on the positive (+) side of the X-axis, which is in contact with the N-pole of the magnet plate 10, and an N-pole is produced at the front and rear end portions of the magnetic body 9*a*. Similarly, an N-pole is produced on that surface of the magnetic body 9*b* located on the negative (−) side of the X-axis, which is in contact with the S-pole of the magnet plate 10, and an S-pole is produced at the front and rear end portions of the magnetic body 9*b*.

Thereby, a magnetic field directed from the magnetic body 9*a* to magnetic body 9*b,* i.e. a negative magnetic field component directed from the (+) side to (−) side along the X-axis, is produced at the front and rear end portions of the magnetic bodies 9*a* and 9*b*. This magnetic field component exerts an upward force to the electron beam passing by the rear end portion of the magnetic body.

In addition, near the surface of the six-pole magnet plate 10, magnetic fluxes of the poles positioned on the X-axis are guided to the magnetic bodies 9*a* and 9*b*. As a result, the negative magnetic field component produced by the magnet plate 10 in the direction from the (+) side to (−) side on the X-axis is weakened. As mentioned above, the magnet plate 10 is designed such that the magnetic field intensity on the trajectory of the center beam becomes zero due to the balance in magnetic field between the two poles on the X-axis and the four poles on the Y-axis in the state in which the magnetic bodies are not disposed. However, when the magnetic bodies are disposed, the magnetic field produced by the two poles on the X-axis is guided by the magnetic bodies and weakened. As a result, the positive magnetic field component produced by the four poles of magnet plate 10 near the Y-axis in the direction from the (−) side to (+) side on the X-axis is relatively increased.

More specifically, in the vicinity of the front end portions of the magnetic bodies, as in the vicinity of the rear end portions, the negative magnetic field component directed from the (+) side to (−) side on the X-axis is produced. However, since the positive magnetic field component produced by the four poles near the Y-axis in the direction from the (−) side to (+) side on the X-axis is relatively strong, a positive magnetic field component is produced as a total magnetic field on the trajectory of the center beam.

In other words, the negative magnetic field component is produced on the trajectories of the side beams near the magnet plate 10, and the positive magnetic field component is produced on the trajectory of the center beam. The direction of the magnetic field on the trajectories of the side beams is opposite to the direction of the magnetic field on the trajectory of the center beam.

As has been described above, as regards the magnetic fields which the respective electron beams emitted from the cathode 16 receive until they travel the deflector on the respective trajectories, a positive magnetic field as a whole acts on the trajectory of the center beam and a negative magnetic field as a whole acts on the trajectories of the side beams. Thus, the side beams passing through the plane of the six-pole magnet plate receive force in the positive direction on the Y-axis and the center beam receives force in the negative direction on the Y-axis.

As a result, as regards the magnet plate wherein when the electron beam trajectory is to be corrected without the provision of the magnetic bodies the center beam is not shifted and both side beams can be shifted by 1.3 mm to the (+) side on the Y-axis, if the magnetic bodies are mounted on the magnet plate, both side beams are moved to the (+) side by 0.5 mm on the Y-axis and the center beam is moved to the (−) side on the Y-axis by 0.8 mm.

This degrades the operability of the magnet plate. Moreover, the center beam moves at the time when the beam trajectory is corrected by the six-pole magnet plate after landing adjustment was effected by the two-pole magnet plate. Consequently, the landing adjustment needs to be effected once again by the two-pole magnet, degrading the efficiency of the adjustment work.

As stated above, when the electron beam trajectory is vertically corrected in the state the magnetic bodies are disposed, such problems will arise that the amount of movement of both side beams decreases and the center beam moves in a direction opposite to the direction of movement of the side beams.

BRIEF SUMMARY OF THE INVENTION

The present invention has been made in order to solve the above problems, and its object is to provide a color cathode ray tube with high adjustment efficiency.

According to the present invention, there is provided a color cathode ray tube comprising:

an envelope including a panel having a phosphor screen on an inner surface thereof, and a neck formed continuous with the panel via a funnel;

an electron gun structure provided within the neck and including cathodes for emitting three electron beams in a direction of a tube-axis toward the panel, the three electron beams being lined side by side along a horizontal axis;

multipole magnetic field generating means provided on an outside of the neck and including at least a multipole magnet plate for producing a multipole magnetic field on trajectories of the electron beams emitted from the cathodes;

a pair of strip-like first magnetic bodies extending in the tube-axis direction and disposed to be opposed to each other, with the electron gun structure interposed therebetween, and to be symmetrical with respect to a Y-Z plane, where the horizontal axis is defined as an X-axis, the tube-axis as a Z-axis and a vertical axis perpendicular to the horizontal axis and the tube-axis as a Y-axis; and second magnetic bodies disposed symmetrical in an X-Y plane with respect to an X-Z plane, wherein the first magnetic bodies, the second magnetic bodies and the multipole magnet plate produce a magnetic field distribution in the direction of the Z-axis on the trajectory of a center beam of the three electron beams emitted from the cathodes, the magnetic field distribution including positive magnetic field components extending from one of the first magnetic bodies to the other first magnetic body and negative magnetic field components extending from the other first magnetic body to the one first magnetic body, and the cathodes are arranged in such a position in the direction of the Z-axis that a sum of the positive magnetic field components is substantially equal to a sum of the negative magnetic field components on the trajectory of the center beam.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

A color cathode ray tube, in particular, an in-line type color cathode ray tube with an in-line type electron gun structure, according to an embodiment of the present invention will now be described in detail with reference to the accompanying drawings.

Figure 5:
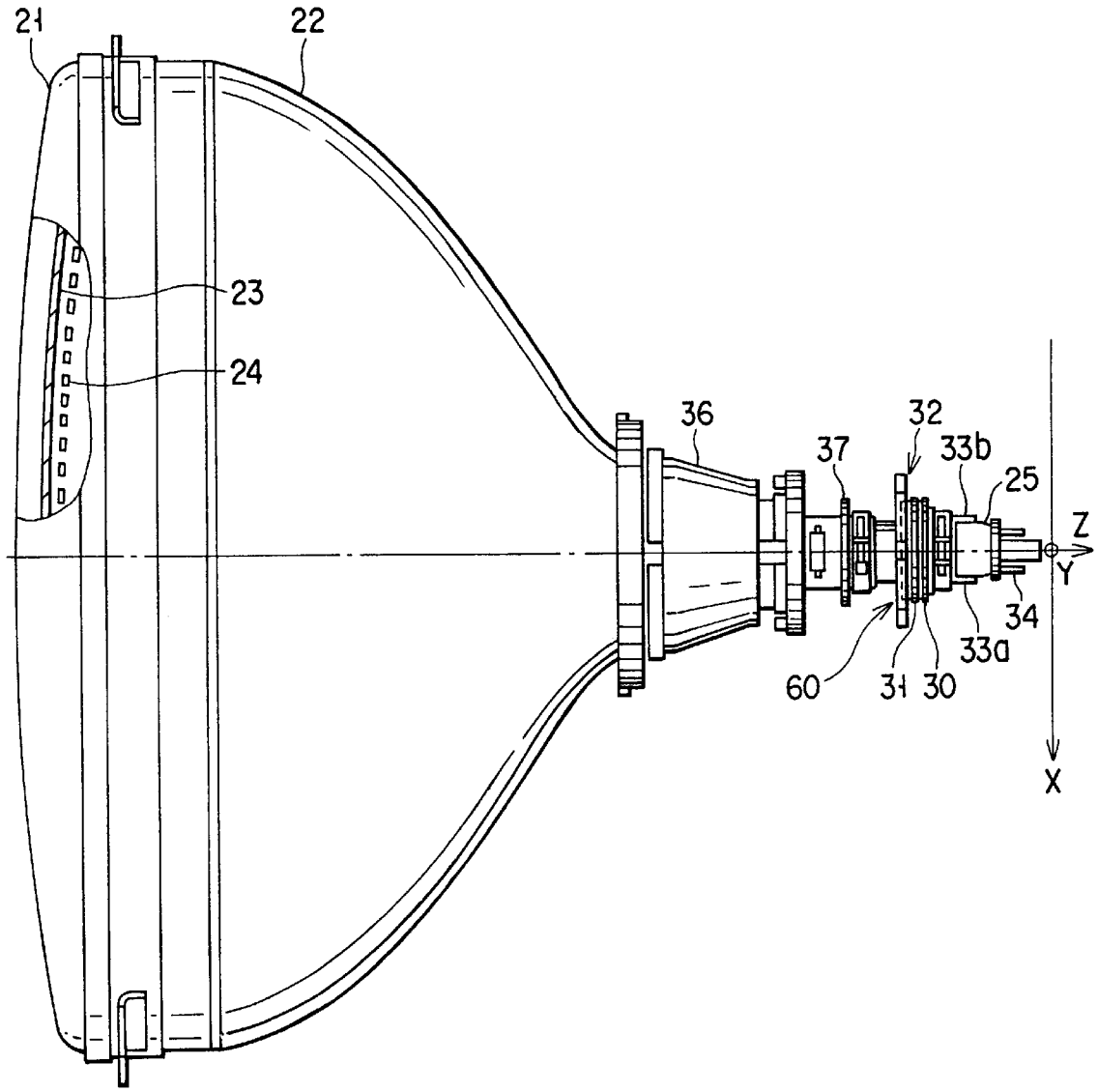
FIG. 5 is a side view schematically showing the structure of the entirety of an in-line type color cathode ray tube according to the present invention.
Figure 6:
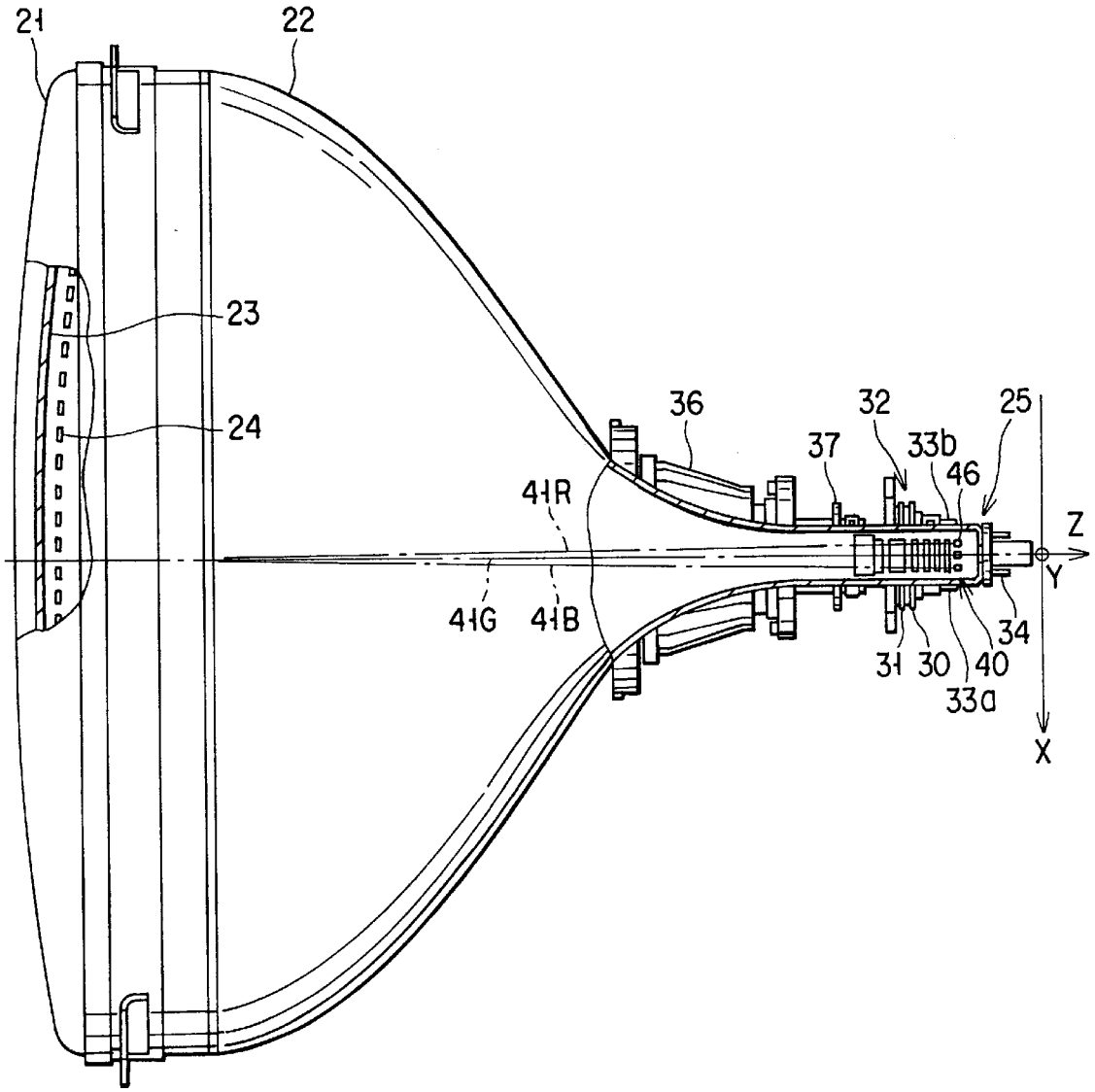
FIG. 6 is a partial cross-sectional view schematically showing the structure of an electron gun provided on a neck of the in-line type color cathode ray tube shown in FIG. 5.

The in-line type color cathode ray tube according to the embodiment, as shown in FIGS. 5 and 6, has an envelope comprising a panel 21, a funnel 22 formed continuous with the panel 21, and a neck 25 formed continuous with the funnel 22 as a small-diameter end portion. The panel 21 has a phosphor screen 23 on its inner surface. The phosphor screen 23 has three-color phosphor dots which emit red (R), green (G) and blue (B). The color cathode ray tube has a shadow mask 24 adjacent to, and oppose to, the phosphor screen 23. The shadow mask 24 has a great number of electron beam passage holes.

The neck 25 of the color cathode ray tube, as shown in FIG. 6, includes an in-line type electron gun structure 40 for emitting three electron beams which are lined side by side on a horizontal axis, i.e. an X-axis. This in-line type electron gun structure 40 emits a center beam 41G directed to green phosphor dots of the phosphor screen 23 and a pair of side beams 41R and 41B directed to red and blue phosphor dots of the phosphor screen 23. The electron gun structure 40 has three in-line cathodes 46 in which heaters are provided, and a plurality of electrodes successively arranged in a tube-axis direction, i.e. a Z-axis direction, from the cathode 46 toward the phosphor screen 23. The respective electrodes function to control, converge and accelerate the electron beams emitted from the cathodes. The cathodes 46 and electrodes are integrally fixed by an insulating support member. Stem pins 34 for supplying predetermined voltage to the in-line type electron gun structure 40 are attached to a rear portion of the neck 25.

In addition, the color cathode ray tube has a deflector 36 for producing a non-homogeneous magnetic field. The deflector 36 is mounted on the outer peripheral surface of a portion extending between the funnel 22 and neck 25. The deflector 36 has a pair of saddle-type horizontal deflection coils and a pair of saddle-type vertical deflection coils. The horizontal deflection coils produce a pincushion-type deflection magnetic field, and the vertical deflection coils produce a barrel-type deflection magnetic field.

The color cathode ray tube has a ring-shaped two-pole magnet 37 and a convergence magnet 32 which are arranged on the outside of the neck 25 located on the rear side of the deflector 36.

The two-pole magnet 37 has a pair of an N-pole and an S-pole arranged to be opposed to each other. A magnetic field produced by the two-pole magnet 37 adjusts an axial displacement of electron beams, that is, an error in incidence angles of electron beams with respect to the shadow mask. In addition, this magnetic field causes the electron beams to impinge upon the associated three-color phosphor dots formed on the phosphor screen. In other words, the two-pole magnet 37 is used to adjust the landing of beams. In the landing adjustment, the side beam 41R is adjusted to impinge upon the red phosphor dots on the phosphor screen 23, the center beam 41G is adjusted to impinge upon the green phosphor dots on the phosphor screen 23, and the side beam 41B is adjusted to impinge upon the blue phosphor dots on the phosphor screen 23.

The convergence magnet 32 has at least two ring-shaped four-pole magnet plates 31 and two ring-shaped six-pole magnet plates 30. Each four-pole magnet plate 31 has two pairs of N-poles and S-poles arranged to be opposed to each other and produces a four-pole static magnetic field. Each six-pole magnet plate 30 has three pairs of N-poles and S-poles arranged to be opposed to each other, and produces a six-pole static magnetic field.

The static magnetic fields produced by the four-pole magnet plates 31 and six-pole magnet plates 30 horizontally and vertically control, in particular, both side beams of the three in-line electron beams and thus register the three electron beams so that the side beams 41R and 41B are equally located on both sides of the center beam 41G.

As described above, the two-pole magnet 37 and convergence magnet 32 function to register the three in-line electron beams, emitted from the electron gun structure 40, at a center of the phosphor screen 23 at the time of non-deflection, thereby achieving high color purity and convergence.

The three electron beams are deflected by the deflector 36 in the horizontal direction, i.e. X-axis direction, and in the vertical direction, i.e. Y-axis direction perpendicular to the horizontal direction. Thus, while being scanned over the phosphor screen 23, the three electron beams are converged to produce a color image on the phosphor screen 23.

Figure 7A:
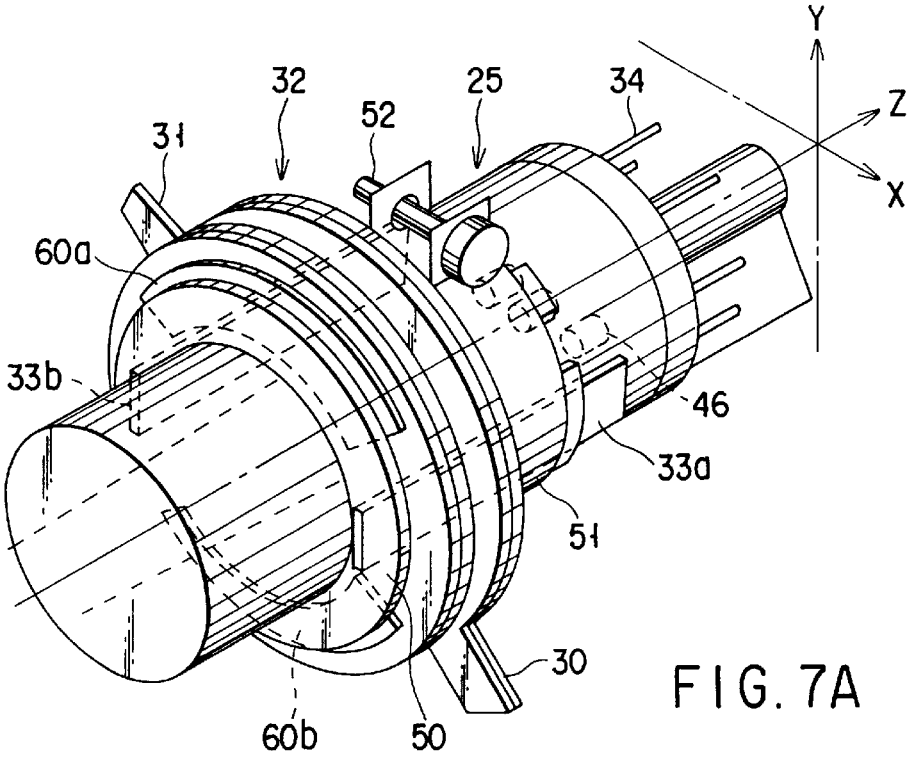
FIG. 7A is a perspective view schematically showing a convergence magnet applied to the in-line type color cathode ray tube shown in FIG. 5.

In the in-line type color cathode ray tube, a pair of strip-like first magnetic bodies 33*a* and 33*b* extending in the Z-axis direction are disposed on both outside portions of the neck 25, as shown in FIG. 7A. The first magnetic bodies 33*a* and 33*b* are used to shield an external magnetic field such as earth magnetism, in particular, an external magnetic field in the Z-axis direction, which will adversely affect the electron beams emitted from the electron gun structure. The paired first magnetic bodies 33*a* and 33*b* are arranged to be opposed to each other on the X-axis.

Specifically, the convergence magnet 32 has at least ring-shaped six-pole magnet plates 30 and four-pole magnet plates 31 for producing static magnetic fields. The convergence magnet 32 is attached to a cylindrical holder 50 for attaching the ring-shaped magnet plates to the neck 25.

The number of six-pole magnet plates 30 and the number of four-pole magnet plates 31 are two, respectively, as mentioned above.

The rotational angles of the two four-pole magnet plates are adjusted in an X-Y plane perpendicular to the Z-axis so that the intensity of the magnetic fields produced by the four-pole magnet plates may be controlled. Specifically, when handle portions of the two magnet plates are placed on each other, the S-pole and N-pole of one of the magnet plates are opposed to the N-pole and S-pole of the other magnet plate. Thus, the magnetic fields of the respective magnet plates cancel each other, and the intensity of magnetic fields produced by the magnet plates becomes minimum. On the other hand, if one of the magnet plates is rotated 90° relative to the other magnet plate, the S-pole and N-pole of one of the magnet plates are opposed to the S-pole and N-pole of the other magnet plate. Thus, the intensity of magnetic fields produced by the magnet plates becomes maximum.

Similarly, when handle portions of the two magnet plates of the six-pole magnet plates 30 are put on each other, the magnetic field intensity becomes minimum. When one of the magnet plates is rotated 60° relative to the other magnet plate, the magnetic field intensity becomes maximum.

In the convergence magnet 32, the six-pole magnet plates 30, four-pole magnet plates 31 and a fixing ring are disposed on the cylindrical holder 50 successively from the stem pin (34) side. A first division spacer is provided between the six-pole magnet plates 30 and four-pole magnet plates 31 in order to mechanically separate them. Similarly, a second division spacer is provided between the four-pole magnet plates 31 and fixing ring.

The convergence magnet 32 having the above structure is fixed on the neck 25 by a clamp band 51 attached to the end portion of the holder 50 and a clamp screw 52.

The pair of first magnetic bodies 33*a* and 33*b* are fixed on the inner surface of cylindrical holder 50 so as to be opposed to each other on the X-axis. Specifically, the first magnetic bodies 33*a* and 33*b* are fixed on the holder 50 so as to be in contact with the outer wall of the neck 25.

In this embodiment, the pair of first magnetic bodies 33*a* and 33*b* are formed of cold-rolled silicon steel plates. The dimensions of each magnetic body 33*a*, 33*b* are, for example, 0.35 mm in wall thickness, 35 mm in length and 4 mm in width.

As is shown in FIG. 7A, second magnetic bodies 60*a* and 60*b* are disposed at a distance of 1.5 mm from the center of the six-pole magnet plates 30 to the deflector side along the Z-axis. The second magnetic bodies 60*a* and 60*b* are provided on the holder 50 so as to be symmetric in the X-Y plane with respect to the X-Z plane. Specifically, the second magnetic bodies 60*a* and 60*b* are separated in the vicinity of the X-axis and are made to face each other over 50° in the vicinity of the Y-axis. The second magnetic bodies 60*a* and 60*b* are formed of plate members, e.g. cold-rolled silicon steel plates with a width of 1.0 mm and a wall thickness of 0.2 mm. These plate members are arcuated with substantially the same radius of curvature as inner portions of the six-pole magnet plates 30.

Figure 7B:
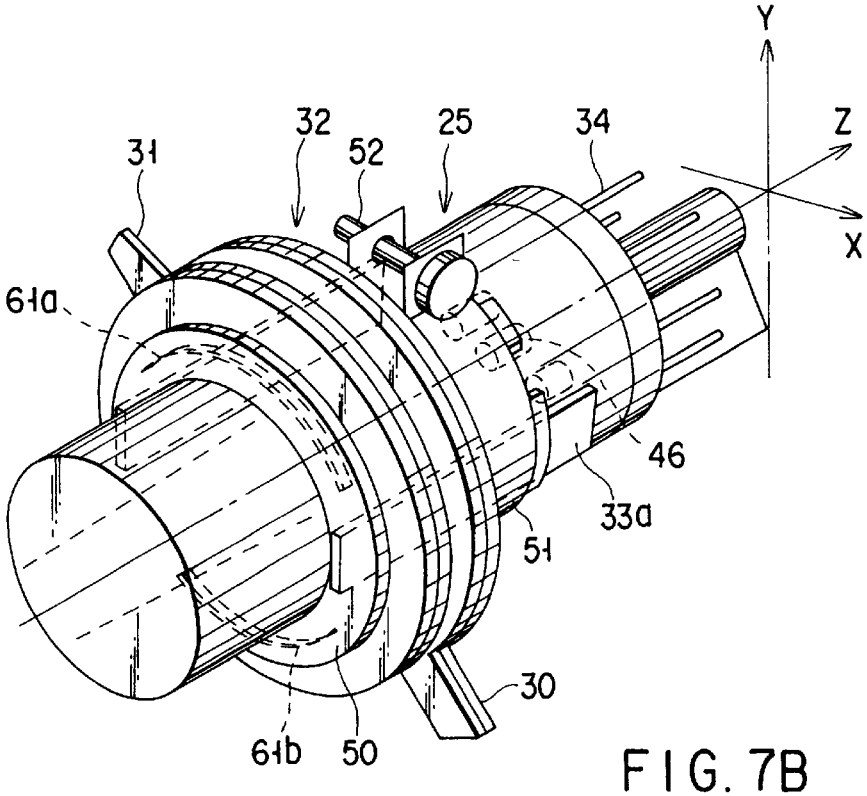
FIG. 7B is a perspective view schematically showing another convergence magnet applied to the in-line type color cathode ray tube shown in FIG. 5.

Alternatively, as shown in FIG. 7B, a pair of cylindrical second magnetic bodies 61*a* and 61*b* may be disposed at a distance of 1.5 mm from the center of the six-pole magnet plates 30 to the deflector side along the Z-axis. The second magnetic bodies 61*a* and 61*b* are formed of cylindrical members, e.g. cold-rolled silicon steel plates with a width of 1.0 mm and a wall thickness of 0.2 mm. These cylindrical members are arcuated with substantially the same radius of curvature as inner portions of the six-pole magnet plates 30.

The second magnetic bodies 61*a* and 61*b* are provided on the inner surface of holder 50 so as to be symmetric in the X-Y plane with respect to the X-Z plane. Specifically, the second magnetic bodies 61*a* and 61*b* are separated in the vicinity of the X-axis and are made to face each other over 50° in the vicinity of the Y-axis.

Even in a case where the cylindrical second magnetic bodies 61*a* and 61*b* shown in FIG. 7B are used, the same advantages as with the use of the arcuated second magnetic bodies 60*a* and 60*b* shown in FIG. 7A can be obtained. The advantages of the use of the second magnetic bodies shown in FIG. 7A will now be described.

Figure 8:
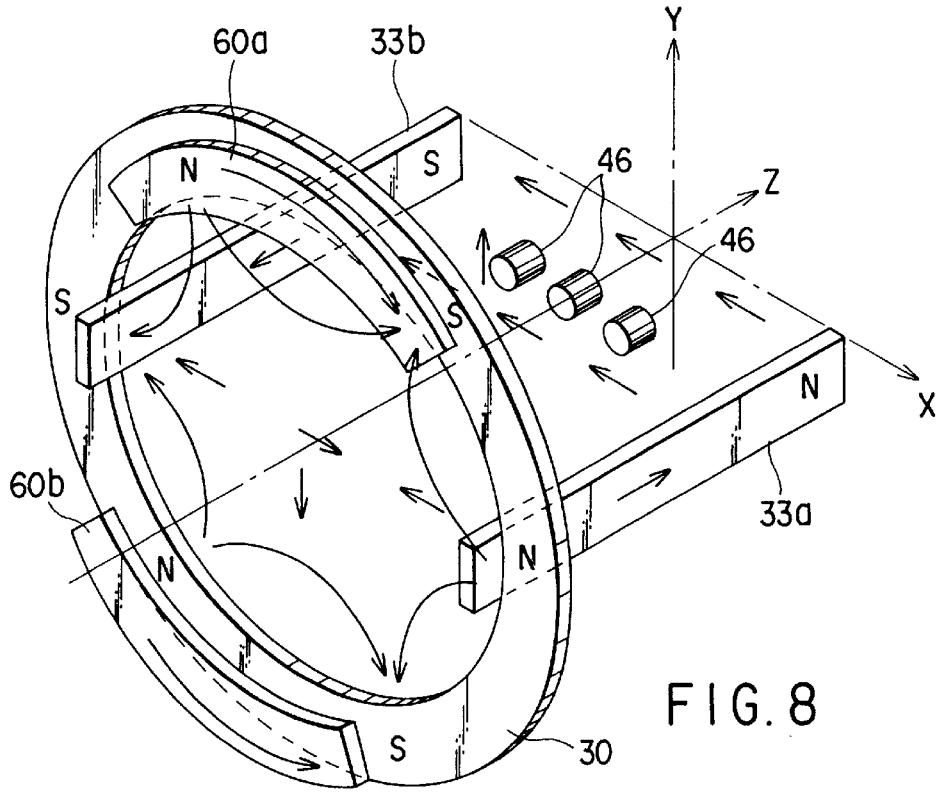
FIG. 8 shows a positional relationship between a six-pole magnet plate and first and second magnetic bodies of the convergence magnet shown in FIG. 7A.

FIG. 8 shows a positional relationship between the six-pole magnet plate and first and second magnetic bodies when the trajectory of the electron beam is corrected vertically upward, i.e. in the (+) direction along the Y-axis.

In this case, the six-pole magnet plate 30 is disposed such that the N-pole and S-pole are opposed to each other on the horizontal axis, i.e. X-axis. In this case, the front end portions of the paired first magnetic bodies 33*a* and 33*b* opposed to each other on the X-axis, i.e. the (−)-side end portions in the Z-axis, are situated close to the N-pole and S-pole of the six-pole magnet plate 30, respectively. Thus, those surface portions of the first magnetic bodies 33*a* and 33*b*, which are situated close to the poles of the six-pole magnet plate 30, are magnetized with polarities opposite to those of the poles of the six-pole magnet plate 30. The entire first magnetic bodies are magnetized in the length direction, i.e. in the Z-direction. As a result, two-pole magnetic fields are produced at the front end portions of the first magnetic bodies, i.e. (−)-side end portions in the Z-axis, and the rear end portions of the magnetic bodies, i.e. (+)-side end portions in the Z-axis. Specifically, S-pole occurs on that surface portion of the magnetic body 33*a* located on the (+) side of X-axis, which is in contact with the N-pole of six-pole magnet plate 30, and N-pole occurs at the front and rear end portions of the magnetic body 33*a*. Similarly, N-pole occurs on that surface portion of the magnetic body 33*b* located on the (−) side of X-axis, which is in contact with the S-pole of six-pole magnet plate 30, and S-pole occurs at the front and rear end portions of the magnetic body 33*b*.

Thereby, a magnetic field extending from the magnetic body 33*a* to the magnetic body 33*b*, i.e. a negative magnetic field extending from the (+) side to (−) side in the X-axis, is produced at the rear end portions of the paired first magnetic bodies 33*a* and 33*b*. Since the rear end portions of the first magnetic bodies 33*a* and 33*b* are located on the stem pin side of the cathodes 46 of the electron gun structure, the negative magnetic field produced at the rear end portions of the magnetic bodies 33*a* and 33*b* will not influence the electron beams emitted from the cathodes 46.

Since intermediate portions of the paired first magnetic bodies 33*a* and 33*b* are magnetized with N-pole and S-pole respectively, a negative magnetic field is produced at the intermediate portions like the rear end portions. With such a magnetic field, electron beams passing by the intermediate portions of first magnetic bodies 33*a* and 33*b* is influenced by an upward force.

In the vicinity of the surface of the six-pole magnet plate 30 and front end portions of the first magnetic bodies 33*a* and 33*b*, magnetic fluxes of the poles located on the X-axis are guided by the first magnetic bodies 33*a* and 33*b*. As a result, the negative magnetic field extending from the (+) side to (−) side on the X-axis, which is produced by the six-pole magnet plate 30 on the electron beam trajectories, is weakened.

In addition, the paired second magnetic bodies 60*a* and 60*b*, which are disposed on the deflector side of the center of the six-pole magnet plate 30 in the Z-axis direction bypass a positive (+) magnetic field extending from the (−) side to (+) side in the X-axis direction, which is produced by the four poles of the six-pole magnet plate in the vicinity of Y-axis. Thus, the positive magnetic field extending from the (−) side to (+) side of X-axis, among the magnetic fields produced by the four poles in the vicinity of Y-axis, which crosses the center beam trajectory, is reduced.

Specifically, the paired first magnetic bodies 33*a* and 33*b* and the paired second magnetic bodies 60 and 60*b* are arranged near the six-pole magnet plate 30, and thus the negative magnetic field produced by the two poles on the X-axis of the six-pole magnet plate 30 is weakened and the positive magnetic field produced by the four poles in the vicinity of Y-axis is weakened. As a result, the center beam of the three beams is influenced by a relatively weak positive magnetic field produced by the six-pole magnet plate 30. The positive magnetic field acting on the trajectory of the center beam can be weakened, as compared to the prior art, and can be reduced to substantially zero.

On the other hand, the side beams are influenced by the negative magnetic fields on their trajectories at the front end portions of the first magnetic bodies 33*a* and 33*b*.

Accordingly, the positive magnetic field acts on the center beam at the front end portions of first magnetic bodies 33*a* and 33*b*, and the center beam receives a downward force, i.e. a negative (−) side force in Y-axis. The negative magnetic field acts on the side beams, and the side beams receive an upward force, i.e. a positive (+) side force in Y-axis.

Figure 9:
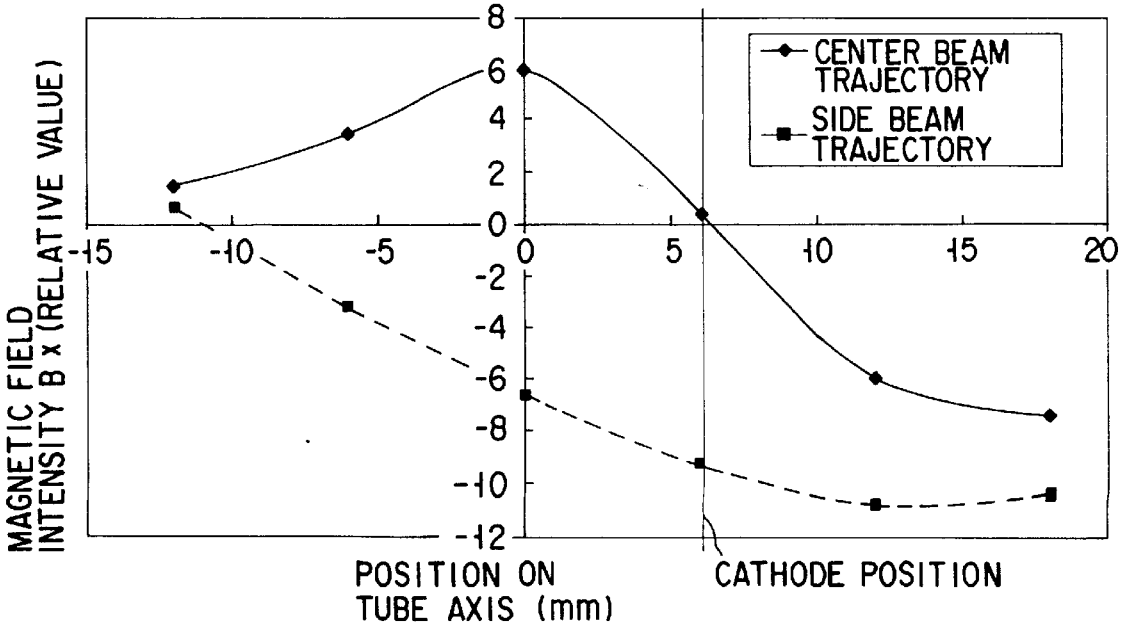
FIG. 9 (PRIOR ART)
FIG. 9 is a graph showing a horizontal magnetic field intensity on an electron beam trajectory in the conventional in-line type color cathode ray tube.
Figure 10:
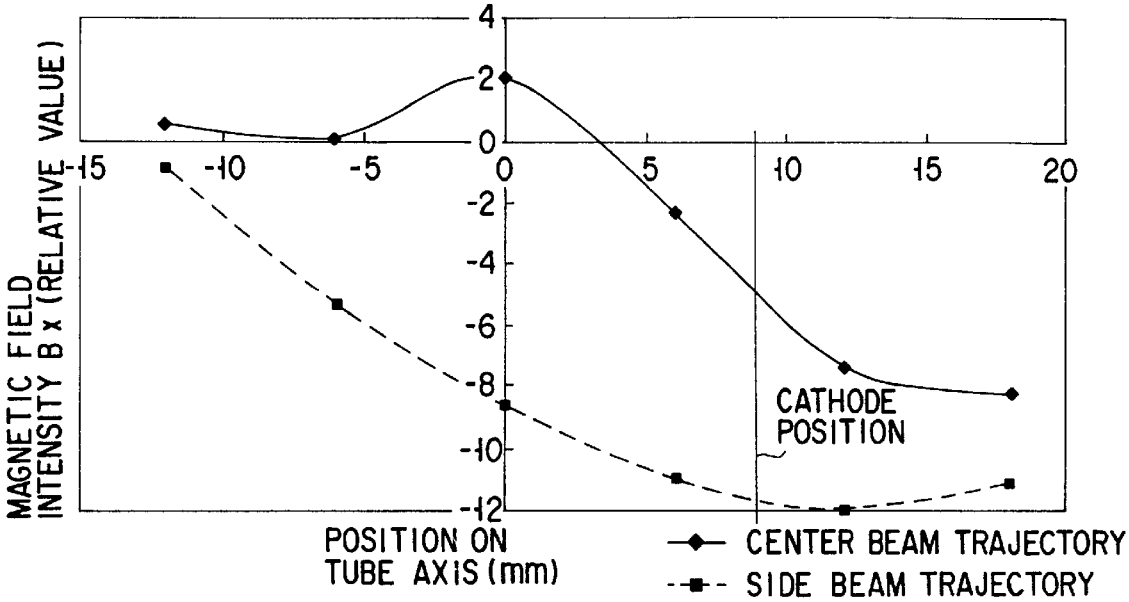
FIG. 10 is a graph showing a horizontal magnetic field intensity on an electron beam trajectory in the in-line type color cathode ray tube according to the present invention.

FIG. 9 is a graph showing a horizontal magnetic field intensity distribution on the electron beam trajectories in the conventional in-line type color cathode ray tube, and FIG. 10 is a graph showing a horizontal magnetic field intensity distribution on the electron beam trajectories in the in-line type color cathode ray tube according to the present embodiment.

In FIGS. 9 and 10, the horizontal axis indicates a position on the tube axis or Z-axis, symbol O indicates a center of the six-pole magnet plate, the negative (−) side corresponds to the deflector side, and the positive (+) side corresponds to the stem pin side. The vertical axis indicates relative values of magnetic field intensities on the trajectories of the center beam and both side beams, and the signs (+, −) indicate the directions of magnetic fields. The positive (+) sign indicates the (+)-directional magnetic field on the X-axis, and the negative (−) sign indicates the (−)-directional magnetic field on the X-axis. In FIGS. 9 and 10, solid lines indicate magnetic field intensity distributions on the trajectory of the center beam, and broken lines indicate magnetic field intensity distributions on the trajectories of side beams.

In FIGS. 9 and 10, a difference between the total of positive magnetic field components and the total of negative magnetic field components in the tube-axis direction from the cathode position toward the deflector corresponds to a magnetic field intensity acting on each electron beam. This magnetic field intensity determines the amount of movement of electron beams in the Y-axis. Specifically, if the difference between magnetic field components has a positive value, the electron beam receives a downward force acting toward the negative (−) side in the Y-axis, as shown in FIG. 8, due to the magnetic field components extending from the (−) side to (+) side on the X-axis. If the difference between magnetic field components has a negative value, the electron beam receives an upward force acting toward the negative (+) side in the Y-axis due to the magnetic field components extending from the (+) side to (−) side on the X-axis.

Figure 1:
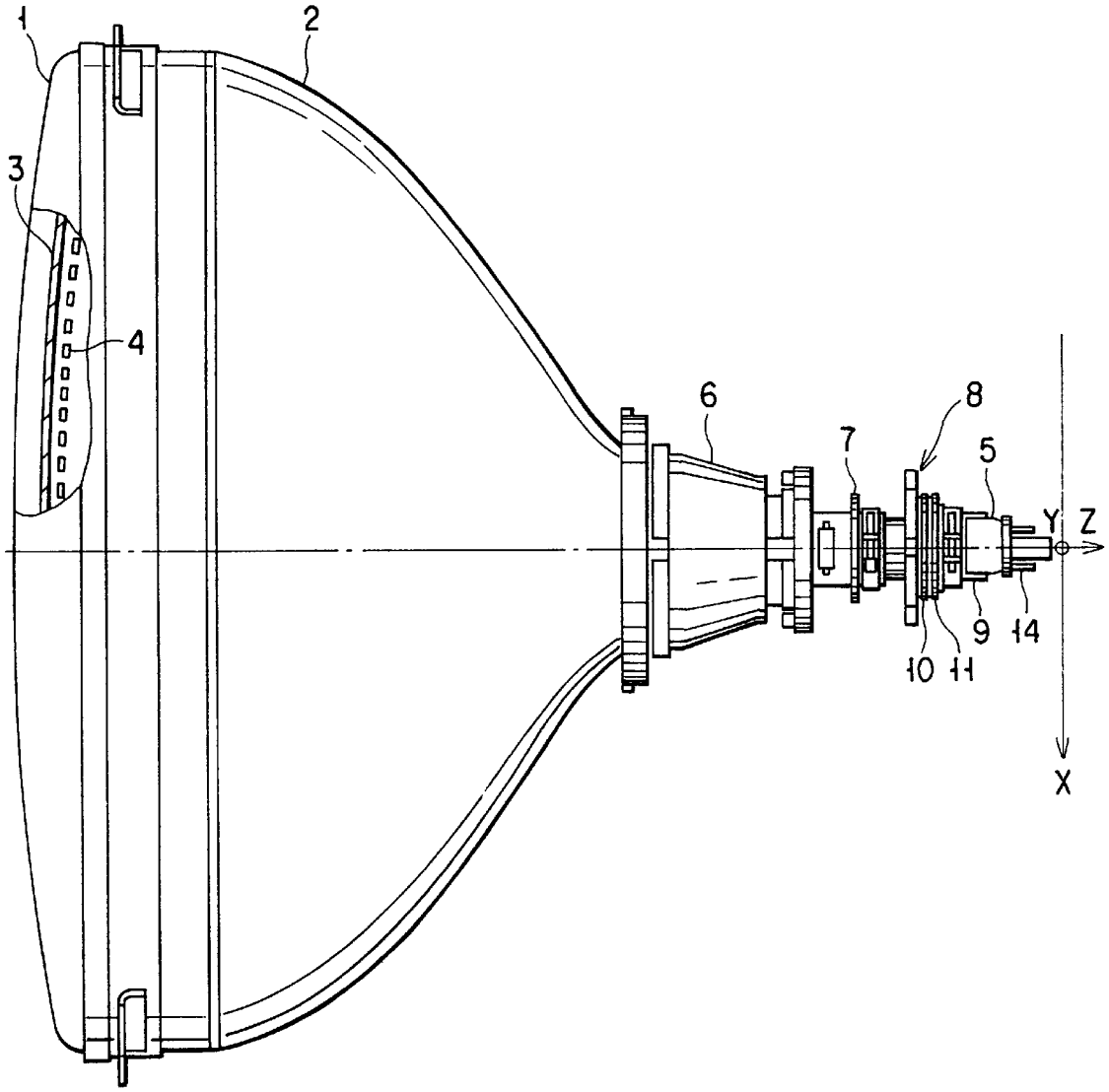
FIG. 1 (PRIOR ART)
FIG. 1 is a side view schematically showing the structure of the entirety of a conventional in-line type color cathode ray tube.
Figure 2:
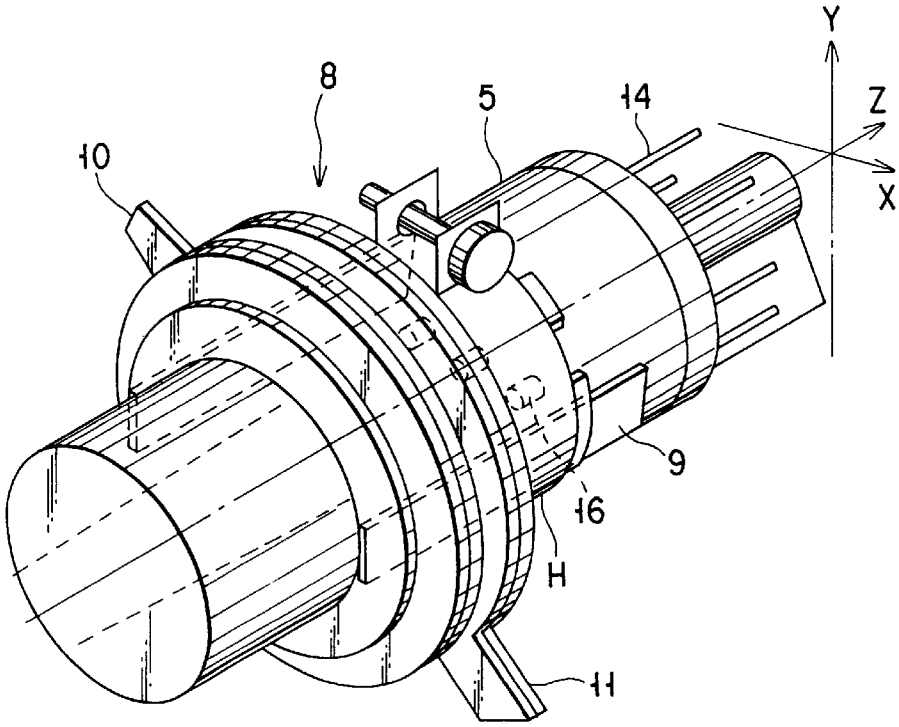
FIG. 2 (PRIOR ART)
FIG. 2 is a perspective view schematically showing a convergence magnet of the conventional in-line type color cathode ray tube shown in FIG. 1.
Figure 3:
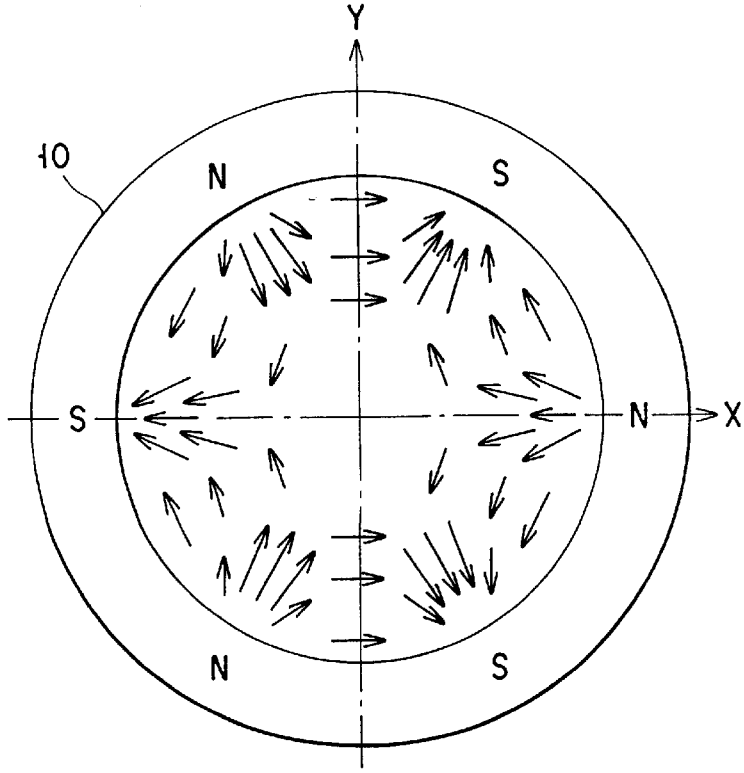
FIG. 3 illustrates a distribution of a magnetic field produced by a six-pole magnet plate of the convergence magnet.
Figure 4A:
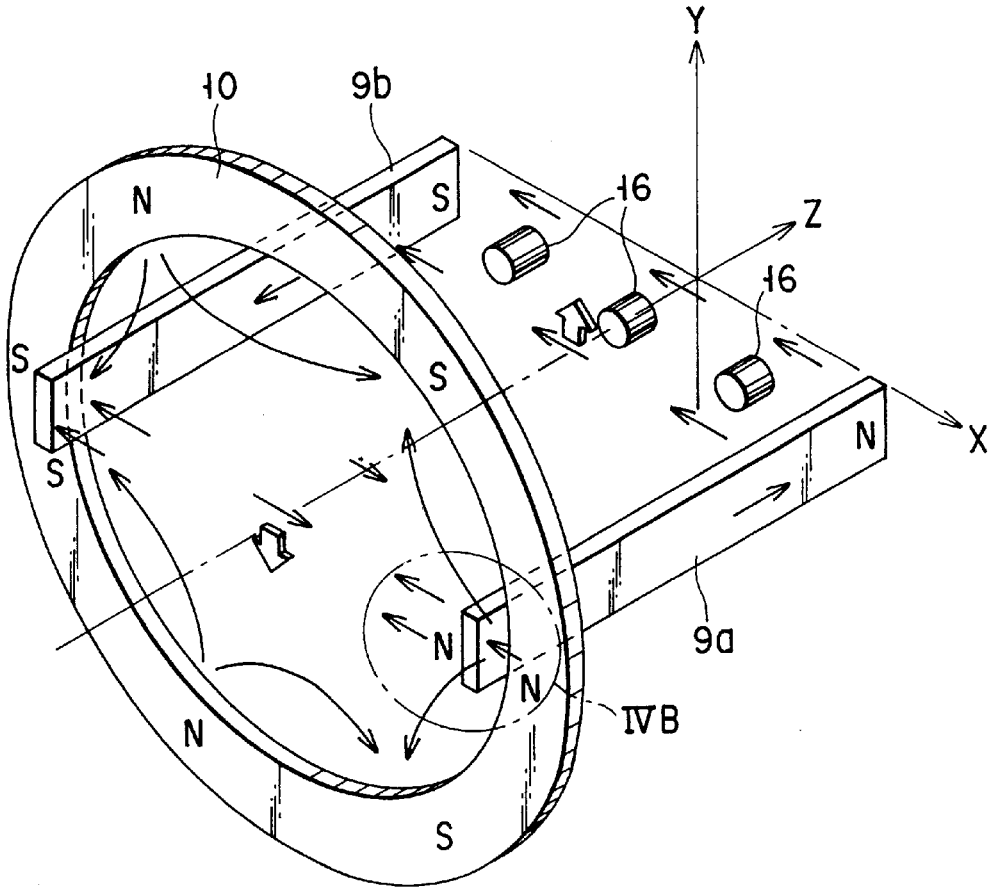
FIG. 4A (PRIOR ART)
FIG. 4A shows a positional relationship between the convergence magnet shown in FIG. 2 and magnetic bodies.
Figure 4B:
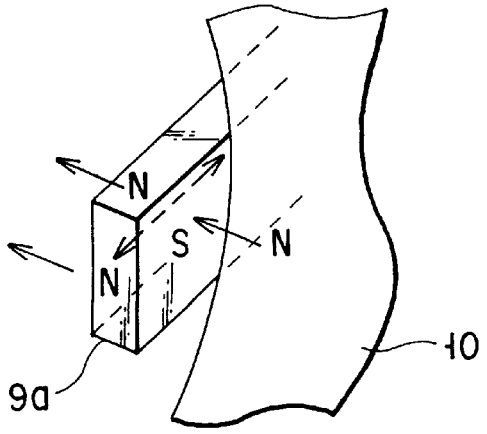
FIG. 4B (PRIOR ART)
FIG. 4B is an enlarged view of the region of an intersection between the six-pole magnet plate shown in FIG. 4A and magnetic bodies.

In the example in FIG. 9, only a pair of first magnetic bodies 9*a* and 9*b* are arranged on the convergence magnet, as shown in FIG. 4A. The front end portions of the first magnetic bodies are situated close to the six-pole magnet. The first magnetic bodies are arranged such that their front end portions are located at −5 mm and their rear end portions are located at +30 mm. The cathodes are positioned at +6 mm.

In this case, in the stem pin-side region where the first magnetic bodies are provided, negative magnetic fields are produced on the trajectories of the center and side beams. In the vicinity and the front side of the six-pole magnet, a strong positive magnetic field is produced on the trajectory of the center beam.

The cathodes are situated at +6 mm, and a strong positive magnetic field component acts on the trajectory of the center beam, as shown in FIG. 9, on the deflector side of the cathodes. Accordingly, a downward negative (−) force in Y-axis acts on the center beam.

When the trajectory of the side beam is varied, it is desirable that the amount of movement of the center beam be zero, and accordingly that the difference in magnetic field components on the center beam trajectory be zero. In other words, in this example, the positive magnetic field intensity needs to be reduced in order to reduce the amount of movement of the center beam.

Suppose that when the electron beam trajectory is to be corrected by means of the six-pole magnet plate, the magnet plate, which is not provided with magnetic bodies, can move the side beams upward by 1.3 mm while the amount of movement of the center beam is zero. In this case, if the magnet plate is provided with the magnet bodies, as in the example of FIG. 9, the center beam moves downward by 0.8 mm and the side beams move upward by 0.5 mm.

In the example in FIG. 10, the convergence magnet has a pair of first magnet bodies 33*a* and 33*b* and a pair of second magnet bodies 60*a* and 60*b*, as shown in FIG. 8. The first magnetic bodies have their front end portions positioned at −5 mm and their rear end portions positioned at +30 mm.

The cathodes are situated at +9 m. The position of the cathodes is near the point on the center beam trajectory, at which the sign of the magnetic field component is inverted from the positive to the negative, and is on the stem pin side of the point at which the polarity of the magnetic field component is inverted. Since the electron beams emitted from the cathodes travel to the deflector side, i.e. the (−) side in the tube axis direction, the magnetic field on the stem pin side of the cathodes does not act on the electron beams. Thus, the strong negative magnetic field components on the stem pin side of the cathodes can be restricted so as not to act on the electron beams.

As regards the magnetic field intensity distribution on the center beam trajectory from the cathode position to the deflector side, a negative magnetic field component occurs in a range from the cathode position at +9 mm to the position at about +3 mm along the tube axis, and the polarity of the magnetic field is inverted at about +3 mm. A positive magnetic field component occurs in a range from the position at +3 mm to the deflector side.

If the magnetic field intensity distribution on the center beam trajectory in FIG. 10 is compared to that in FIG. 9, the positive magnetic field component decreases due to the function of the second magnetic bodies near the six-pole magnet. Since the position of the cathodes relative to the six-pole magnet plate is shifted to the stem pin side, as compared to the prior art, the negative magnetic field component increases.

Accordingly, in the X-directional magnetic field acting on the center beam of the electron beams emitted from the cathodes toward the deflector side, an integration value of positive magnetic field components is substantially equal to an integration value of negative magnetic field components and these components cancel each other.

If the sum of absolute values of the integration value of positive magnetic field components and the integration value of negative magnetic field components in the magnetic field intensity distribution is supposed to be 100%, the integration value of positive magnetic field components in the example of FIG. 9 is 100% and the integration value of negative magnetic field components is 0%. Thus only the positive magnetic field components are present. By contrast, in the example in FIG. 10, the integration value of positive magnetic field components is 45% and the integration value of negative magnetic field components is 55%. The integration values of magnetic field intensities of the respective components are substantially equal.

Accordingly, a difference between the sum of positive magnetic field components acting on the center beam and the sum of negative magnetic field components acting on the center beam can be reduced to a minimum, and the force acting on the center beam can be reduced to a minimum.

On the other hand, negative magnetic field components act on the side beams and the integration value thereof is greater than that in the prior art shown in FIG. 9. Therefore, the side beams can be effectively moved upward.

In the present embodiment, the amount of movement of each side beam is 1.3 mm on the (+) side in the Y-axis and the amount of movement of the center beam is 0.2 mm on the (−) side in the Y-axis. The variation in landing in this case is 1 $\mu$m which is within a range of allowable adjustment error. The amount of movement of side beams is equal to that in the state in which the electron beam trajectory is adjusted by the six-pole magnet plate with no magnetic bodies provided.

The reason for this is that the magnetic field produced by the four poles of the six-pole magnet plate in the vicinity of Y-axis is bypassed by the adjacent poles by the second magnetic bodies. Thereby, the positive magnetic field component and negative magnetic field component produced by the six-pole magnet plate to act on the center beam trajectory are balanced. The magnetic field intensity can be desirably adjusted by varying the wall thickness, magnetic permeability, 0width, etc. of the second magnetic body.

Figure 11:
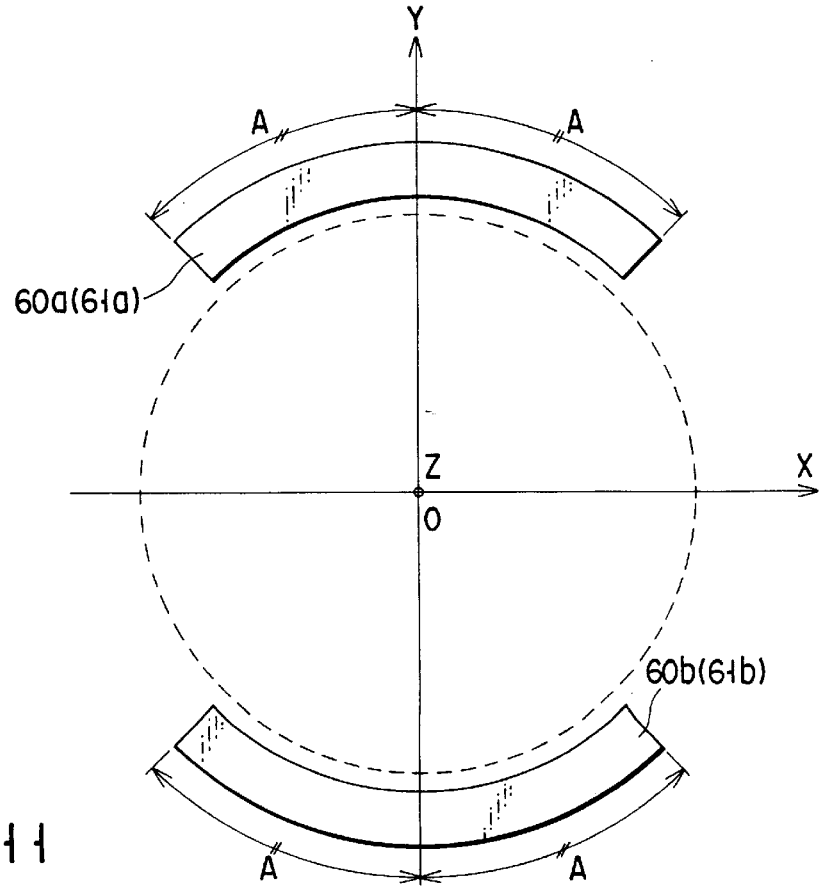
FIG. 11 is a view for describing an occupation angle A at which the second magnetic bodies are arranged.

In the color cathode ray tube according to the present embodiment, the pair of arcuated second magnetic bodies 60*a* and 60*b* (61*a*, 61*b*), as shown in FIG. 11, which are shaped so as to have substantially the same radius of curvature as the inside shape of the six-pole magnet plate 30, are arranged in the vicinity of Y-axis with respect to a symmetry axis or the X-axis.

In a case where the six-pole magnet plate 30 is formed in a ring with a circular inside shape, the second magnetic bodies 60*a* and 60*b* (61*a*, 61*b*) are formed in a plat plate shape (or cylindrical shape) extending along a circumference having a center at the intersection O between the X-axis and Y-axis. The paired second magnetic bodies 60*a* and 60*b* (61*a*, 61*b*) are arranged symmetrical with respect to the Y-axis so as to extend over a predetermined occupation angle A about the intersection O from the Y-axis. The length of each second magnetic body 60*a*, 60*b* (61*a*, 61*b*) is proportional to the occupation angle A from the intersection O.

The second magnetic bodies are opposed to each other and separated in the vicinity of X-axis. However, the second magnetic bodies may be formed in a ring shape. In this case, the ring-shaped second magnetic body may be used as a spacer for mechanically separating, for example, the six-pole magnet plate and the four-pole magnet plate or fixing ring. Accordingly, the convergence magnet can be assembled with higher efficiency if the ring-shaped second magnetic.body is used, as compared to the case where a pair of second magnetic bodies are arranged opposed to each other. Furthermore, if the ring-shaped second magnetic body is used also as spacer, the number of parts can be reduced.

Figure 12:
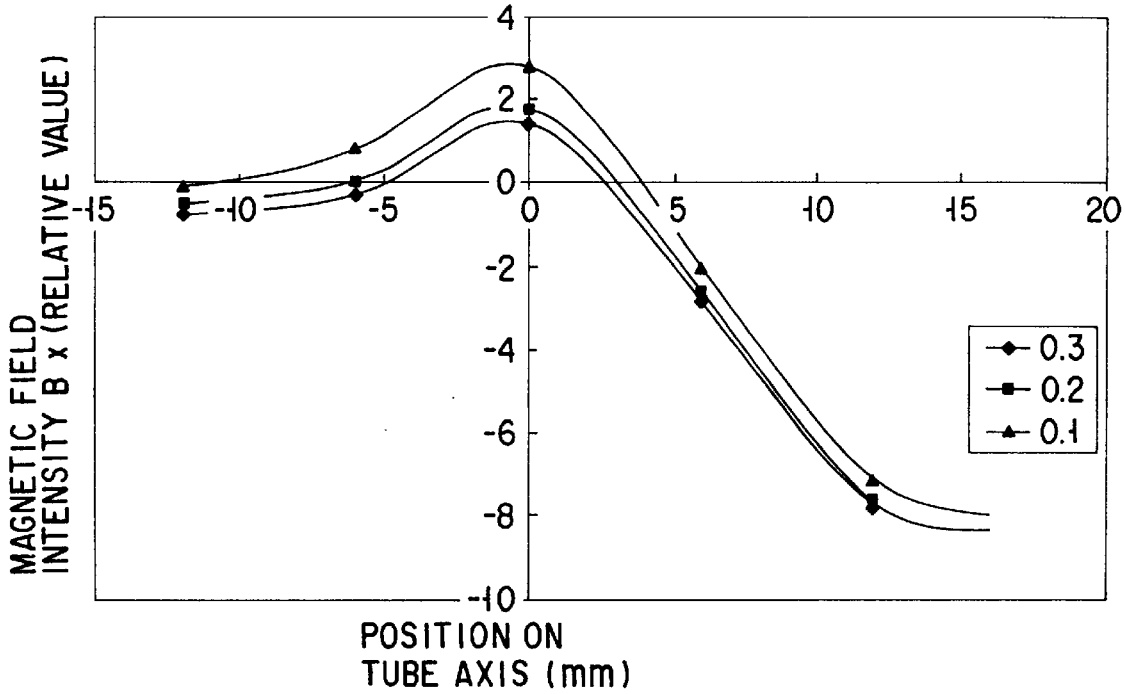
FIG. 12 shows intensity distribution curves of a magnetic field on a center beam trajectory when the thickness of the second magnetic body has been varied, with the occupation angle A of the second magnetic body set at 30°.

FIG. 12 shows intensity distribution curves of a magnetic field on the center beam trajectory when the thickness of the second magnetic body has been varied, with the occupation angle A of the second magnetic body set at A=30°. The second magnetic bodies are disposed at −1.5 mm in the tube axis direction, as in the case of FIG. 7A.

FIG. 12 shows magnetic field intensity distributions in cases where the wall thickness of the second magnetic body is 0.1 mm, 0.2 mm and 0.3 mm. As is shown in FIG. 12, if the wall thickness of the second magnetic body is increased, the positive magnetic field component decreases and the negative magnetic field component increases. In particular, in the vicinity of the center of the six-pole magnet plate (position O in the tube axis direction), if the wall thickness of the second magnetic body is increased, the positive magnetic field component can be effectively reduced.

As has been described above, by properly choosing the thickness of the second magnetic body, the positive magnetic field component and negative magnetic field component can be balanced on the center beam trajectory.

Figure 13:
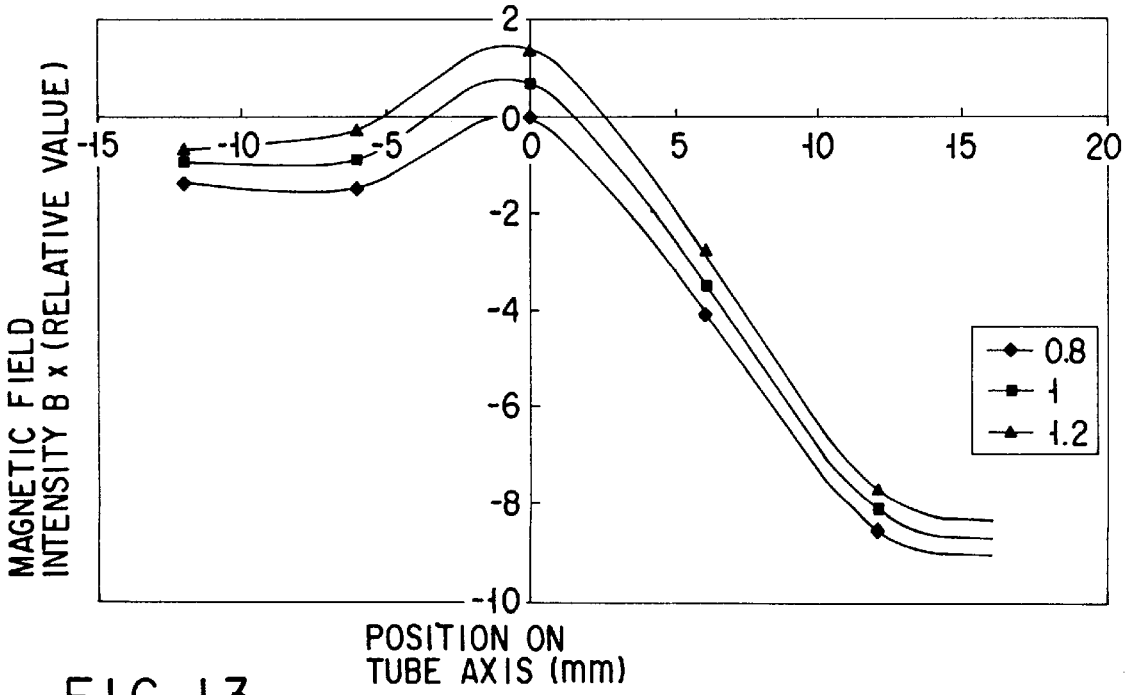
FIG. 13 shows intensity distribution curves of a magnetic field on a center beam trajectory when the distance between the second magnetic bodies and the six-pole magnet plate in the tube axis direction has been varied, with the shape of each second magnetic body being the same as that shown in FIG. 7A.

FIG. 13 shows intensity distribution curves of a magnetic field on a center beam trajectory when the distance between the second magnetic bodies and the six-pole magnet plate in the tube axis direction has been varied, with the shape of each second magnetic body being the same as that shown in FIG. 7A. The occupation angle A of the second magnetic bodies is 30°, and the wall thickness and width thereof are the same as those in FIG. 7A.

In the case shown in FIG. 13, the second magnetic bodies are separated from the center of the six-pole magnet plate at a predetermined distance to the deflector side in the tube axis direction. The magnetic field intensity distributions shown in FIG. 13 were obtained when the distance is set at 0.8 mm (−0.8 mm), 1.0 mm (−1.0 mm) and 1.2 mm (−1.2 mm).

As is shown in FIG. 13, if the distance between the second magnetic bodies and the six-pole magnet plate is decreased, the positive magnetic field component decreases and the negative magnetic field component increases. In particular, in the vicinity of the center of the six-pole magnet plate, if the distance between the second magnetic bodies and the six-pole magnet plate is decreased, the positive magnetic field component can be effectively decreased.

By properly choosing the distance between the second magnetic bodies and six-pole magnet plate, the positive and negative magnetic field components on the center beam trajectory can be balanced.

Figure 14:
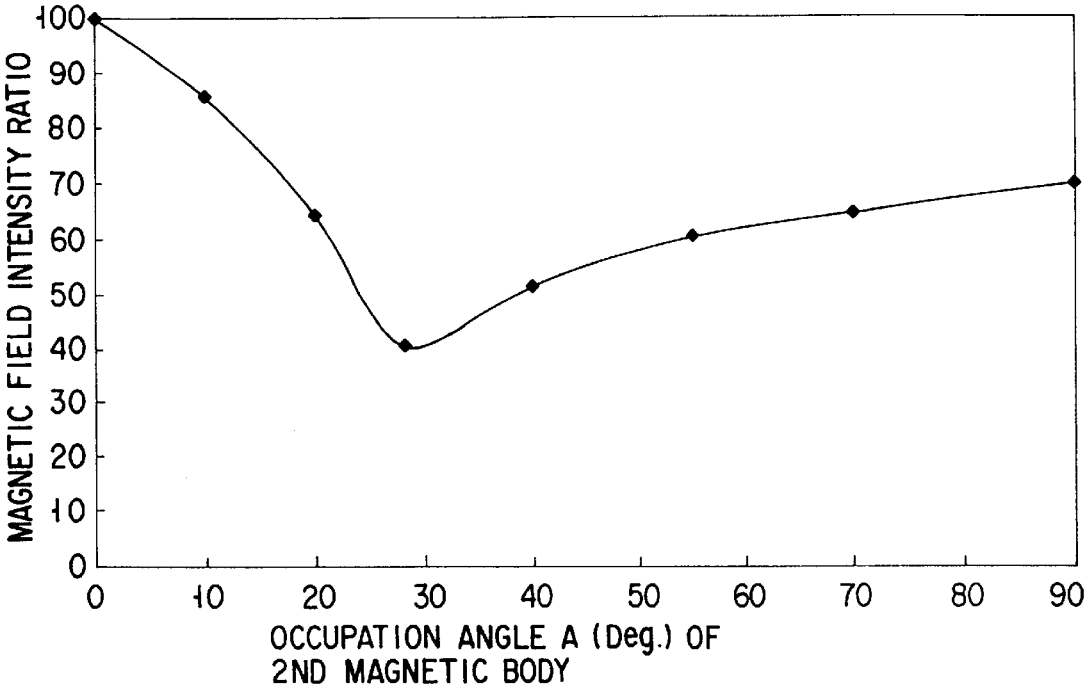
FIG. 14 shows a ratio in intensity of a magnetic field acting on a center beam in relation to the occupation angle A of the second magnetic body.
Figure 15:
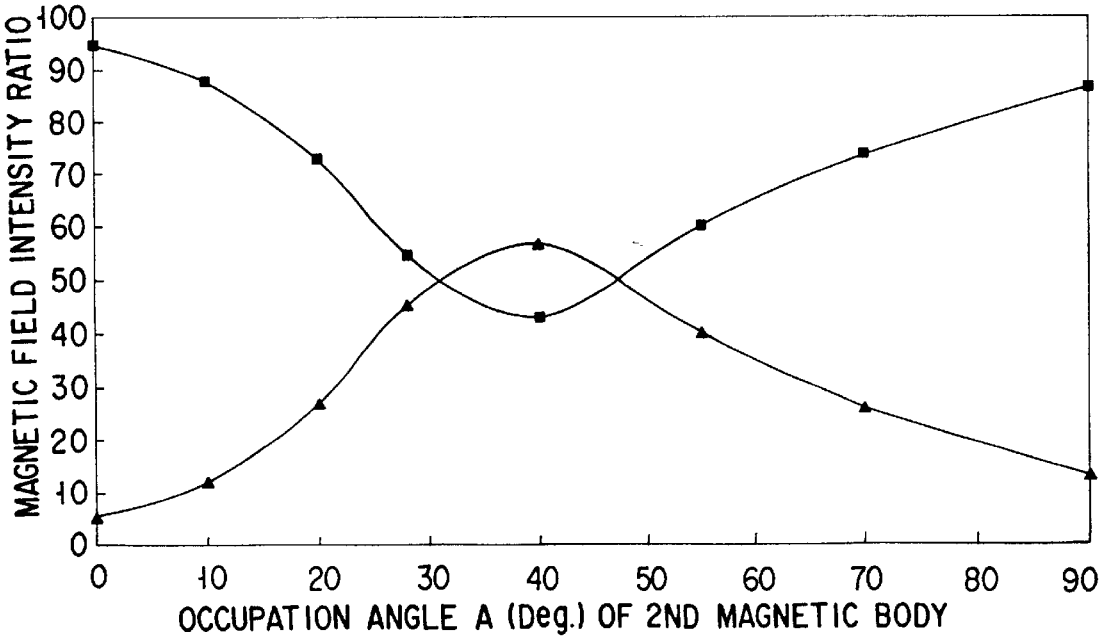
FIG. 15 shows a ratio of an integration value of a positive magnetic field to an integration value of magnetic field intensity and a ratio of an integration value of a negative magnetic field to the integration value of magnetic field intensity, in relation to the occupation angle A of the second magnetic body.

FIGS. 14 and 15 show relationships between the occupation angle A of the second magnetic bodies and the integration value of the intensity of the magnetic field acting on the center beam.

In FIG. 14, the horizontal axis indicates the occupation angle A of the second magnetic bodies, and the vertical axis indicates the magnetic field intensity ratio of the field acting on the center beam. When the occupation angle is 0° on the horizontal axis, this means that the second magnetic bodies are not provided. When the occupation angle is 90°, the second magnetic bodies are formed in a continuous ring shape.

The magnetic field intensity ratio in FIG. 14 is the ratio of the integration value of the magnetic field intensity in the case where the second magnetic bodies with a predetermined occupation angle are provided. In FIG. 14, the integration value of the magnetic field intensity acting on the center beam when the second magnetic bodies are not provided (occupation angle=0°), i.e. the sum of absolute values of the positive and negative magnetic field components, is set at 100%.

As is shown in FIG. 14, when the occupation angle of the second magnetic bodies is about 30°, the magnetic field intensity ratio takes a minimum value and it is found that the sum of the magnetic field intensity on the center beam trajectory is small independently of the polarity of the field.

FIG. 15 shows a ratio of an integration value of a positive magnetic field to an integration value of magnetic field intensity acting on the center beam and a ratio of an integration value of a negative magnetic field to the integration value of magnetic field intensity acting on the center beam. In the state in which the second magnetic bodies are not provided, most magnetic field components are positive. If the second magnetic bodies are provided, the positive magnetic field component decreases and the negative magnetic field component increases in accordance with the increase in occupation angle of the second magnetic bodies.

It is understood that when the occupation angle A is in a range of from about 25° to about 50°, preferably about 30° or about 45°, the ratio of the positive magnetic field component becomes substantially equal to that of the negative magnetic field component and this range of occupation angles is optimal.

If the occupation angle A increases beyond this optical range, the positive magnetic field component increases and the negative magnetic field component decreases.

By properly choosing the occupation angle A of the second magnetic bodies in this manner, the positive and negative magnetic field components on the center beam trajectory can be balanced.

As has been described above, the wall thickness of the second magnetic bodies, the distance between the second magnetic bodies and six-pole magnet plate, and the occupation angle A of the second magnetic bodies are properly chosen, and thereby the integration value of the positive magnetic field component of the magnetic field intensity acting on the center beam and the integration value of the negative magnetic field component can be balanced. Accordingly, the cathodes are arranged under the condition that the positive and negative magnetic field components are canceled, and undesirable movement of the center beam can be suppressed.

According to the color cathode ray tube of the present invention, as described above, in addition to the pair of magnetic bodies disposed opposed to each other to shield the external magnetic field acting on the electron beam, there are provided a pair of second magnetic bodies disposed symmetrical with respect to the horizontal axis in the vicinity of the six-pole magnet plate. The second magnetic bodies are formed to have substantially the same radius of curvature as the inside shape of the six-pole magnet plate.

Thus, the second magnetic bodies bypass the magnetic fields directed to the center beam, the fields being produced by those poles of the six-pole magnet plate, which are situated near the vertical axis. Accordingly, the magnetic field acting on the center beam can be suppressed without reducing the magnetic fields acting on both side beams. The center beam receives little force which may vary its trajectory, while the side beams receive force which may vertically vary their trajectories. Therefore, the trajectories of the side beams can be vertically varied, without varying the trajectory of the center beam.

Accordingly, the operability of the convergence magnet is enhanced and the center beam is prevented from moving at the time of correction due to the six-pole magnet plate after the landing adjustment by the two-pole magnet is finished. Therefore, there is no need to carry out the landing adjustment by the two-pole magnet plate once again, and the in-line type color cathode ray tube with high adjustment efficiency can be presented.

As has been described above, the present invention can provide a color cathode ray tube with high operability and high adjustment efficiency.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

an envelope including a panel having a phosphor screen on an inner surface thereof, and a neck formed continuous with the panel via a funnel;

an electron gun structure provided within the neck and including cathodes for emitting three electron beams in a direction of a tube-axis toward the panel, the three electron beams being lined side by side along a horizontal axis;

multipole magnetic field generating means provided on an outside of the neck and including at least a multipole magnet plate for producing a multipole magnetic field on trajectories of the electron beams emitted from the cathodes;

a pair of strip-like first magnetic bodies extending in the tube-axis direction and disposed to be opposed to each other, with the electron gun structure interposed therebetween, and to be symmetrical with respect to a Y-Z plane, where said horizontal axis is defined as an X-axis, said tube-axis as a Z-axis and a vertical axis perpendicular to the horizontal axis and the tube-axis as a Y-axis; and second magnetic bodies disposed symmetrical in an X-Y plane with respect to an X-Z plane, wherein said first magnetic bodies, said second magnetic bodies and said multipole magnet plate produce a magnetic field distribution in the direction of the Z-axis on the trajectory of a center beam of the three electron beams emitted from the cathodes, the magnetic field distribution including positive magnetic field components extending from one of the first magnetic bodies to the other first magnetic body and negative magnetic field components extending from said other first magnetic body to said one first magnetic body, and the cathodes are arranged in such a position in the direction of the Z-axis that a sum of the positive magnetic field components is substantially equal to a sum of the negative magnetic field components on the trajectory of the center beam.

2. The color cathode ray tube according to claim 1, wherein the magnetic field distribution on the trajectory of the center beam has a plurality of intensity peaks in which the positive magnetic field component and the negative magnetic field component are alternately repeated, and the cathodes are situated between the second intensity peak and the third intensity peak, as counted from the panel side.

3. The color cathode ray tube according to claim 2, wherein a sum of magnetic field components including the first intensity peak, as counted from the panel side, of the intensity peaks of the magnetic field distribution is substantially equal to a sum of magnetic field components including the second intensity peak all of said magnetic field components acting on the center beam.

4. The color cathode ray tube according to claim 2, wherein the magnetic field distribution has three intensity peaks in which the positive magnetic field component and the negative magnetic field component are alternately repeated.

5. The color cathode ray tube according to claim 1, wherein said pair of first magnetic bodies are provided on an outer surface of the neck such that the first magnetic bodies cover locations of the cathodes of the electron gun structure provided within the neck.

6. The color cathode ray tube according to claim 1, wherein said pair of first magnetic bodies are provided integral to the multipole magnetic field generating means.

7. The color cathode ray tube according to claim 1, wherein the multipole magnetic field generating means includes a cylindrical holder mounted on the neck, a ring-shaped first magnet plate for generating a four-pole magnetic field and a ring-shaped second magnet plate for generating a six-pole magnetic field, and said pair of first magnetic bodies are provided on an inner surface of the holder.

8. The color cathode ray tube according to claim 1, wherein the electron gun structure is an in-line type electron gun structure having three cathodes lined side by side on the horizontal axis, and a plurality of electrodes arranged in the direction of the tube-axis from the cathodes, the in-line type electron gun structure emitting three in-line electron beams.

9. The color cathode ray tube according to claim 1, wherein said second magnetic bodies are composed of a pair of arcuated magnetic bodies formed to be discontinuous in the vicinity of the X-axis and arranged symmetrical in the X-Y plane with respect to the X-Z plane.

10. The color cathode ray tube according to claim 1, wherein said second magnetic bodies are composed of a pair of cylindrical magnetic bodies formed to be discontinuous in the vicinity of the X-axis and arranged symmetrical in the X-Y plane with respect to the X-Z plane.

11. The color cathode ray tube according to claim 1, wherein said second magnetic bodies are composed of integral magnetic bodies formed and disposed in a ring shape.

12. The color cathode ray tube according to claim 1, wherein said second magnetic bodies have substantially the same radius of curvature as an inner surface of the multipole magnet plate.

13. The color cathode ray tube according to claim 1, wherein said second magnetic bodies are composed of a pair of magnetic bodies disposed symmetric with respect to the X-Z plane in the X-Y plane in the vicinity of the multipole magnet plate and being arcuated in a range of from 25° to 40° from the Y-axis about an original point or an intersection of the X-, Y- and Z-axes.

14. The color cathode ray tube according to claim 1, wherein said second magnetic bodies are provided integral to the multipole magnetic field generating means.

15. The color cathode ray tube according to claim 1, wherein the multipole magnetic field generating means includes a cylindrical holder, a ring-shaped first magnet plate for generating a four-pole magnetic field, a ring-shaped second magnet plate for generating a six-pole magnetic field, and a spacer provided between the first and second magnet plates, and said second magnetic bodies are provided on an inner surface of the cylindrical holder.

16. The color cathode ray tube according to claim 15, wherein said second magnetic bodies are composed of integral magnetic bodies formed and disposed in a ring shape and are provided as a spacer for the multipole magnetic field generating means.

* * * * *